US010323415B2

(12) United States Patent
Oshima et al.

(10) Patent No.: US 10,323,415 B2
(45) **Date of Patent: *Jun. 18, 2019**

(54) PREGROUTED PC STEEL MATERIAL AND CURING METHOD FOR PREGROUTED LAYER THEREIN

(71) Applicants: Sumitomo (SEI) Steel Wire Corp., Itami-shi (JP); Sumitomo Electric Industries, Ltd., Osaka-shi (JP)

(72) Inventors: Katsuhito Oshima, Itami (JP); Masato Yamada, Itami (JP); Yoshiyuki Matsubara, Itami (JP); Kiminori Matsushita, Itami (JP); Shuichi Tanaka, Itami (JP); Jun Sugawara, Osaka (JP); Shingo Nakajima, Osaka (JP)

(73) Assignee: Sumitomo (SEI) Steel Wire Corp., Itami-shi (JP)

( * ) Notice: Subject to any disclaimer, the term of this patent is extended or adjusted under 35 U.S.C. 154(b) by 116 days.

This patent is subject to a terminal disclaimer.

(21) Appl. No.: 14/891,638

(22) PCT Filed: Dec. 18, 2014

(86) PCT No.: PCT/JP2014/083527

§ 371 (c)(1),
(2) Date: Nov. 16, 2015

(87) PCT Pub. No.: WO2015/098683

PCT Pub. Date: Jul. 2, 2015

(65) Prior Publication Data

US 2016/0076250 A1 Mar. 17, 2016

(30) Foreign Application Priority Data

Dec. 25, 2013 (JP) ..... 2013-266343
Dec. 4, 2014 (JP) ..... 2014-245912

(51) Int. Cl.
*E04C 5/08* (2006.01)
*E04G 21/12* (2006.01)
(Continued)

(52) U.S. Cl.
CPC ..... *E04C 5/085* (2013.01); *E04C 5/01* (2013.01); *E04C 5/08* (2013.01); *E04C 5/10* (2013.01); *E04G 21/12* (2013.01)

(58) Field of Classification Search
CPC ..... E04G 21/12; E04C 5/01; E04C 5/085; E04C 5/10; E04C 5/08
See application file for complete search history.

(56) References Cited

U.S. PATENT DOCUMENTS 4,631,883 A * 12/1986 Harris ..... E04C 5/08 52/223.14
4,849,282 A 7/1989 Watanabe et al.
(Continued)

FOREIGN PATENT DOCUMENTS

EP 0198398 A2 10/1986
JP S61-233149 A 10/1986
(Continued)

OTHER PUBLICATIONS

English Machine Translation of Watanbe (JP H05-038818, B).*
(Continued)

*Primary Examiner* — Holly C Rickman
*Assistant Examiner* — Linda N Chau
(74) *Attorney, Agent, or Firm* — Baker Botts L.L.P.; Michael A. Sartori

(57) ABSTRACT

A pregrouted PC steel material (10) includes a 19-wire-twisted PC strand (1), a pregrouted layer (2) disposed on an outer periphery of the PC strand (1), and a sheath (3) configured to cover an outer periphery of the pregrouted layer (2). A filling resin (4) is filled between steel wires (side
(Continued)

wires) (1*b*, 1*c*, 1*d*). Since the filling resin (4) does not exude to the pregrouted layer (2) before tensioning of the PC strand (10), an operation of tensioning the PC strand (1) is not hindered by curing of the pregrouted layer (2). In contrast, since the gap between the steel wires is reduced when the PC strand (1) is tensioned, the filling resin (4) flows out (exudes) from between the steel wires to the pregrouted layer (2) to cure the pregrouted layer (2) only after the reduction.

6 Claims, 5 Drawing Sheets

(51) Int. Cl.
*E04C 5/10* (2006.01)
*E04C 5/01* (2006.01)

(56) References Cited

U.S. PATENT DOCUMENTS

| | | | |
|---|---|---|---|
| 5,208,077 | A | 5/1993 | Proctor et al. |
| 2015/0159377 | A1 | 6/2015 | Saiki et al. |

FOREIGN PATENT DOCUMENTS

| | | | | |
|---|---|---|---|---|
| JP | H05-038818 | B | | 6/1993 |
| JP | H05-038818 | B2 | | 6/1993 |
| JP | H05-200825 | A | | 8/1993 |
| JP | H05-200825 | A | | 8/1993 |
| JP | 08-226191 | A | | 9/1996 |
| JP | 10-226973 | | * | 8/1998 |
| JP | 2000-281967 | A | | 10/2000 |
| JP | 2000-281967 | A | | 10/2000 |
| JP | 2003-172001 | | * | 6/2003 |
| JP | 2003-172001 | A | | 6/2003 |
| JP | 2003-172001 | A | | 6/2003 |
| JP | 2005-171581 | A | | 6/2005 |
| JP | 3786599 | B2 | | 6/2005 |
| JP | 2005171581 | A | * | 6/2005 |
| JP | 2007-211486 | A | | 8/2007 |
| JP | 2007-211486 | A | | 8/2007 |
| JP | 2008-255183 | A | | 10/2008 |
| JP | 2009-108497 | A | | 5/2009 |
| JP | 2009-108497 | A | | 5/2009 |
| JP | 2012-117243 | A | | 6/2012 |
| JP | 2012-154097 | A | | 8/2012 |
| WO | 2009054489 | A1 | | 4/2009 |
| WO | WO-2014/021056 | A1 | | 2/2014 |

OTHER PUBLICATIONS

English Machine Translation of Nakajima (JP 2012-154097).*
Machine English Translation: Ishibashi (JP 2005-171581).*
English Machine Translation: Sumiya (JP 2003-172001) and Chigiri (JP 10-226973), 2003.*
Extended European Search Report in counterpart European Patent Application No. 14875354.4 dated Nov. 21, 2016.
International Search Report in PCT International Application No. PCT/JP2014/083527, dated Feb. 3, 2015.
International Search Report in PCT International Application No. PCT/JP2013/068495 dated Aug. 27, 2013.
Notification of the First Office Action in Chinese Patent Application No. 2013800401640, dated Sep. 25, 2015.
Extended European Search Report in European Patent Application No. 13826257.1, dated Mar. 14, 2016.
Office Action in U.S. Appl. No. 14/418,885 dated Apr. 21, 2017.
Final Office Action in U.S. Appl. No. 14/418,885 dated Mar. 14, 2018.
Notice of Allowance in U.S. Appl. No. 14/418,885 dated Jun. 29, 2018.

* cited by examiner

PREGROUTED PC STEEL MATERIAL AND CURING METHOD FOR PREGROUTED LAYER THEREIN

TECHNICAL FIELD

The present invention relates to a pregrouted PC (prestressed concrete) steel material, for use in a PC construction method such as a PC post tensioning method, and a curing method for a pregrouted layer in the pregrouted PC steel material.

BACKGROUND ART

A typical post tensioning method tensions and fixes a PC steel material by inserting the PC steel material in a cylindrical sheath buried in concrete beforehand, and applies compressive stress to the concrete by the reaction force of tensioning force. This method covers the disadvantage such that the tensile strength of the concrete is low.

In this post tensioning method, a grout material, such as cement milk, is injected and mixed between the sheath and the PC steel material to prevent adhesion between the PC steel material and the concrete and corrosion of the PC steel material.

Since the operation of injecting the grout material is performed at the construction site, it is troublesome and increases the cost. For this reason, a pregrouted PC steel material, in which the sheath, the PC steel material, and the grout material described above are provided beforehand has been used. This pregrouted PC steel material includes a PC strand formed by twisting a plurality of steel wires (element wires) together, a pregrouted layer disposed on an outer periphery of the PC strand to contain the PC strand, and a sheath that covers an outer periphery of the pregrouted layer (see paragraph 0005 and FIG. 2 of PTL 1).

In the post tensioning method using this pregrouted PC steel material, the pregrouted material (pregrouted layer) is required to have a long tensionable period in which the PC grout material does not cure until the PC strand is tensioned, and needs to cure at ordinary temperature after the PC strand is fixed by the application of tensioning force (after concrete is compressed).

For this reason, to support the action, there have been proposed various kinds of grout materials, that is, a grout material whose composition, viscosity, and so on are determined according to the curing time to cure the grout material in a required time (PTL 1, claim 1), a grout material in which a curing agent is mixed at a mixture ratio in accordance with the curing time (PTL 2, claim 1), and a grout material whose compounding is devised (PTL 3, claim 1).

CITATION LIST

Patent Literature

PTL 1: Japanese Unexamined Patent Application Publication No. 2003-172001

PTL 2: Japanese Unexamined Patent Application Publication No. 2000-281.967

PTL 3: Japanese Unexamined Patent Application Publication No. 2009-108497

PTL 4: Japanese Unexamined Patent Application Publication No. 2007-211486

PTL 5: Japanese Unexamined Patent Application Publication No. 2012-154097

PTL 6: Japanese Unexamined Patent Application Publication No. 05-200825

SUMMARY OF INVENTION

Technical Problem

In any of the above-described pregrouted PC steel materials of the related art, the curing agent is mixed beforehand, or compounding or the like of the grout material is devised. However, the curing degree changes according to the environment such as temperature, and the construction period often deviates from the planned period. When the construction period is extended, curing of the grout material proceeds, and this may hinder the operation of tensioning the PC steel material.

Owing to these circumstances, as a long tensionable period as possible is often required. For this reason, compounding of resin in presently applied pregrouted layer is designed to extend the tensionable period. However, since the tensionable period and the curing time are in a trade-off relationship, several years are generally needed until the pregrouted layer cures completely.

In contrast, as the means for curing a pregrouted layer at an arbitrary time, heating elements are provided in a sheath (PTL 4). However, it is necessary to energize the heating elements after a PC strand is tensioned, and this makes die operation troublesome.

Further, capsules containing a curing agent are mixed in a pregrouted layer (PTL 5, Abstract). However, in this technique, the capsules are broken via the pregrouted layer by tensioning force of a PC steel material so that the curing agent flows into the pregrouted layer. Hence, the capsules may not be broken smoothly. That is, the curing time of the pregrouted layer is unstable.

While paragraph 0022 of PTL 1 also describes the idea of mixing, in a pregrouted layer, microcapsules in each of which a curing agent is wrapped with a coating film, these capsules are broken by dissolution of the coating film due to water or the like in the pregrouted layer or heat application so that the curing agent therein flows into the pregrouted layer.

In view of the above circumstances, an object of the present invention is to allow a pregrouted layer to be cured by means other than the above-described heating means from an initial period where promotion of curing is demanded.

Solution to Problem

To achieve the above object, a pregrouted PC steel material according to the present invention includes a PC strand formed by twisting a plurality of steel wires, a pregrouted layer disposed on an outer periphery of the PC strand to contain the PC strand, and a sheath configured to cover an outer periphery of the pregrouted layer. A filling resin configured to promote curing of the pregrouted layer is filled between the steel wires in the PC strand. The filling resin does not exude to the pregrouted layer before tensioning of the PC strand, and exudes to the pregrouted layer owing to a tensioning force during the tensioning.

Advantageous Effects of Invention

Since the present invention has the above-described features, the filling resin starts flowing out to the pregrouted layer and curing proceeds from an initial period in which promotion of curing of the pregrouted layer is demanded and in which compressive stress is applied to concrete by tensioning the PC strand. Hence, the construction period can be shortened without hindering the operation of tensioning the PC strand.

DESCRIPTION OF EMBODIMENTS

Description of Embodiments of the Invention

Figure 1:
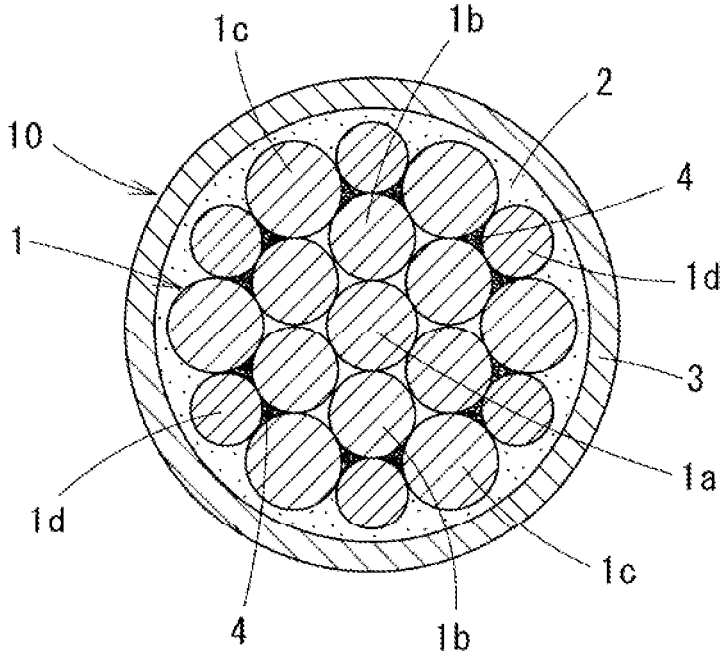
FIG. 1 is a cross-sectional view of a pregrouted PC steel material according to an embodiment of the present invention.

A pregrouted PC steel material according to an embodiment of the present invention includes a PC strand formed by twisting a plurality of steel wires, a pregrouted layer disposed on an outer periphery of the PC strand to contain the PC strand, and a sheath that covers an outer periphery of the pregrouted layer. The pregrouted PC steel material adopts a structure in which a filling resin for promoting curing of the pregrouted layer (hereinafter referred to as a filling resin) is filled between the steel wires in the PC strand and the filling resin does not exude to the pregrouted layer before tensioning of the PC strand and exudes to the pregrouted layer owing to tensioning force during the tensioning.

That is, an initial period in which promotion of curing of the pregrouted layer is demanded is the time when, after concrete is cast, it is subjected to prestressing, that is, a PC steel material is tensioned and fixed and compressive stress is applied to the concrete by reaction force of the tensioning force. For this reason, first, curing of the pregrouted layer is promoted when the compressive stress is applied to the concrete by the tensioning force.

Next, a filling resin for promoting curing of the pregrouted layer is filled between the steel wires in the PC strand during prestressing in order to promote curing of the pregrouted layer. According to this structure, the filling resin between the steel wires in the PC strand does not exude until the PC strand is tensioned (before tensioning and fixing start), and the filling resin exudes to cure the pregrouted layer only after the gap between the steel wires is reduced during tensioning.

According to the above, in this structure, the filling resin does not flow out to the pregrouted layer until the PC strand is tensioned, and this does not hinder the operation of tensioning the PC strand by curing of the pregrouted layer. In contrast, when the PC strand is tensioned, the gap between the steel wires is certainly reduced. Hence, the filling resin flows out (exudes) to the pregrouted layer and cures the pregrouted layer only after the reduction. That is, the initial period when curing of the pregrouted layer promoted is the time of prestressing when the PC strand is tensioned to apply compressive stress to the concrete after the concrete is cast.

In this structure, when a spacer or the like is interposed between layers of the steel wires to widen the gap between the layers to be filled with the filling resin, the amount of filling resin filled in the gap can be increased. Hence, the degree of curing of the pregrouted layer is adjusted easily.

As the pregrouted layer, well-known resins conventionally used, for example, epoxy resin or a resin mainly composed of epoxy resin can be adopted.

The filling resin exudes from between the steel wires in the PC strand into the grout resin layer (pregrouted layer) owing to reduction of the gap between the steel wires during the tensioning operation, and thereby promotes curing of the grout resin layer. When the pregrouted layer is formed of epoxy resin or a resin mainly composed of epoxy resin, for example, a curing agent for epoxy resin is conceivable as the filling resin. While the filling resin may be powder or beads obtained by granulating the powder, it may be microcapsules wrapped with coating films that are dissolved by moisture absorption or broken by tensioning force of the PC strand (filled with filling resin).

While only the curing agent may be used (alone) as the epoxy resin curing agent used in the filling resin, a binder resin can be appropriately mixed therein. While the kind of binder resin is not particularly limited, epoxy resin, that can finally cure together with the grout resin is preferably used.

As the curing agent for epoxy resin, an amine-based compound, an anhydride-based compound, an amide-based compound, a phenol-based compound, and a carboxylic compound are given as examples. These curing agents may be used alone, or two or more of these may be used. While the kind of coring agent is not particularly limited, a ketimine is suitable from the viewpoint of the tensionable period of the steel material.

As epoxy resin used in the binder resin, a novolac epoxy resin, a bisphenol A epoxy resin, a biphenyl epoxy resin, a triphenylmethane epoxy resin, and a phenolic aralkyl epoxy resin are given as examples. These epoxy resins may be used alone, or two or more of these may be used. While the kind of epoxy resin is not particularly limited, a bisphenol A epoxy resin is suitable because of its viscosity and ease of treatment.

When the filling resin is a mixture of epoxy resin and an epoxy resin curing agent, the optimal compounding amount of epoxy resin curing agent differs according to the combination thereof. For example, when, a bisphenol A epoxy resin and a ketimine are combined, the compounding amount of ketimine is 2.5 to 30 phr, preferably 3.5 to 20 phr, and more preferably 4.5 to 15 phr.

The curing speed may be insufficient when the compounding amount of ketimine is too small, and the tensionable period of the steel material may be insufficient when the compounding amount of ketimine is too large.

An organic filler can be added to the filling resin as necessary. This addition, of the filler can improve a thickening property, a thixotropic property, and a drip preventive property of the filling resin. As the organic filler, powders of crystalline silica, fused silica, alumina, zircon, calcium silicate, calcium carbonate, calcium oxide, silicon carbide, silicon nitride, boron nitride, zirconia, forsterite, steatite, spinel, titania, and talc or beads formed by spheroidizing these powders are given as examples, but the organic filler is not limited thereto. These fillers may be used alone, or two or more of these may be used. The content of the organic filler is such as to occupy 0 to 95 wt % of the curable resin composite of the present invention. Further, to the filling resin of the present invention, a silane coupling agent, a parting agent, such as stearin acid, palmitic acid, zinc stearate, and calcium stearate, various compounding agents such as pigment, and various thermoplastic resins can be added.

Similarly to the related art, prestressing of concrete by this pregrouted PC steel material is performed by burying the pregrouted steel material in the concrete beforehand, casting the concrete, and then tensioning a PC strand.

At this time, the gap between the steel wires in the PC strand is reduced by the tensioning force. The filling resin filled in the gap is caused to exude into the pregrouted layer and cure the pregrouted layer.

Details of Embodiments of the Invention

FIG. 1 illustrates an embodiment. Similarly to the related art, a pregrouted PC steel material 10 of this embodiment includes a multilayer PC strand 1 formed by twisting a plurality of steel wires 1*a*, 1*b*, 1*c*, and 1*d*, such as piano wires, together, a pregrouted layer 2 disposed on an outer periphery of the PC strand 1 to contain the PC strand 1 and formed of epoxy resin (grout material), and a sheath 3 formed of polyethylene to cover an outer periphery of the pregrouted layer 2. A filling resin 4 is filled (in gaps) between side wires (steel wires) 1*b*, 1*c*, and 1*d*.

In this embodiment, the diameters of the steel wires 1*a*, 1*b*, and 1*c* are 6.0 to 7.0 mm, the diameter of the steel wires 1*d* is about 5 mm, the number of steel wires is 19, the diameter of the PC strand 1 is 28.6 mm, and the sheath thickness is about 1.5 mm. As the filling resin 4, a mixture of a bisphenol A epoxy resin and a ketimine is used, and the compounding amount of ketimine in the epoxy resin is 10 phr.

Figure 2A:
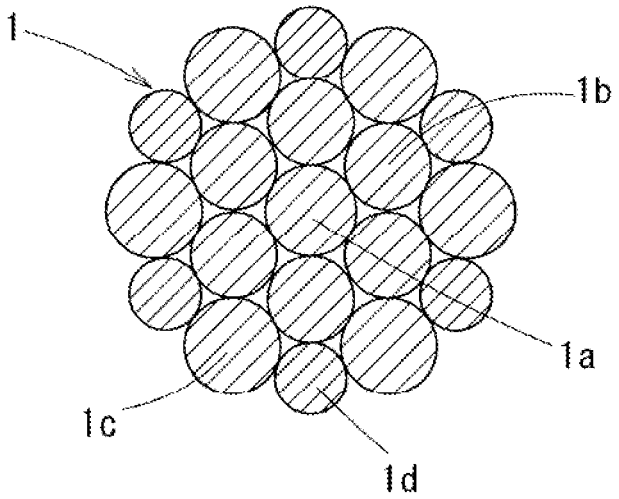
FIG. 2A is an explanatory view illustrating production of the embodiment.

To produce the pregrouted PC steel material 10, first, as illustrated in FIG. 2A, six side wires (inner layer steel wires) 1*b* serving as an inner layer are twisted together around a core wire (steel wire) 1*a*, and twelve side wires (outer layer steel wires) 1*c* and 1*d* serving as an outer layer are twisted together around the inner layer. After stretching or simultaneously with stretching, a strand 1 is subjected to blueing to stabilize a twisted state.

Figure 2B:
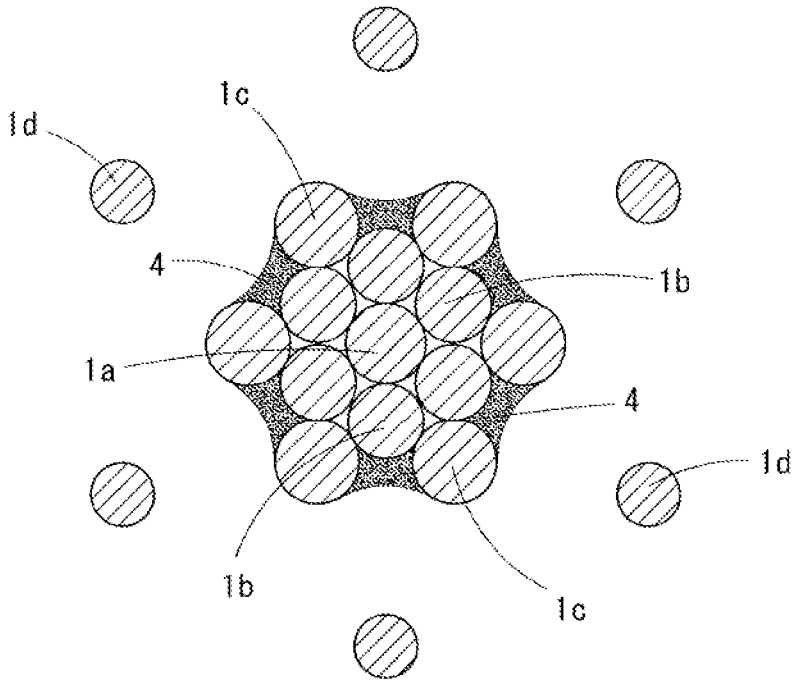
FIG. 2B is an explanatory view illustrating production of the embodiment.
Figure 2C:
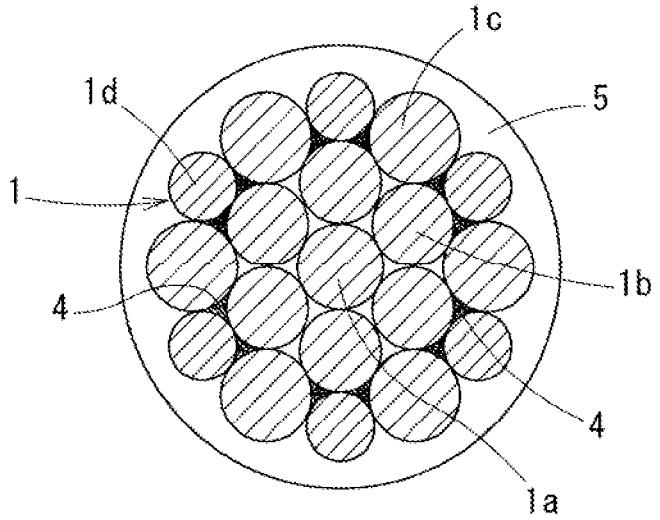
FIG. 2C is an explanatory view illustrating production of the embodiment.

Next, as illustrated in FIG. 2B, the side wires 1*d* in a part of the outer layer of the strand 1 are partly and sequentially detwisted and opened, and a strand composed of the remaining element wires 1*a*, 1*b*, and 1*c* is passed through a kneading tank of a filling resin 4. By this passage through the kneading tank, the strand of 1*b* and 1*c* except for the side wires 1*d* is covered with the filling resin 4. After that, the side wires 1*d* are twisted again. As illustrated in FIG. 2C, the strand 1 to which the filling resin 4 is applied and which is twisted again is passed through a die 5 having an inner peripheral surface shape corresponding to the outer peripheral surface shape of the strand 1, and the filling resin 4 in a part of the outer peripheral surface of the strand 1 (filling resin 4 on the outer peripheral surfaces of the side wires 1*c* and 1*d*) is removed. Also, the filling resin 4 is filled between the side wires 1*b*, 1*c*, and 1*d*. This means for covering the core wire 1*a* and the side wires 1*b* and 1*c* with resin while partly and sequentially detwisting and opening the inner and outer layers of the strand 1 (detwisting means) is well known, as described in paragraphs 0012 to 0034 and FIGS. 1 to 10 of PTL 6.

On the outer periphery of the strand (PC strand) 1 in which the filling resin 4 is thus filled between the side wires 1*b*, 1*c*, and 1*d*, a sheath 3 is formed by extrusion with a pregrouted layer 2 being disposed therebetween, similarly to the related art, whereby a pregrouted PC steel material 10 illustrated in FIG. 1 is obtained. When, the PC strand 1 is contained in the pregrouted layer 2, the filling resin 4 is removed from the outer peripheral surface of the strand 1 by passage through the die 5, and the filling resin 4 between the inner and outer layer steel wires 1*b*, 1*c*, and 1*d* does not exude to the outer periphery of the outer layer, because the steel wires 1*b*, 1*c*, and 1*d* are brought into pressure contact by twisting. For this reason, since the filling resin 4 rarely touches the pregrouted layer 2, the above-described tensionable period can be obtained sufficiently.

This pregrouted PC steel material 10 is used in the post tensioning method, similarly to the related art. After concrete is cast and hardened, the PC strand 1 is tensioned, and compressive stress is applied to the concrete by the reaction force of the tensioning force.

At this time, when the tensioning force of the PC strand 1 was 500 to 700 kN, the filling resin 4 flew out (exuded) to the pregrouted layer 2. By the flow of the filling resin 4, the pregrouted layer 2 could be completely cured in a period corresponding to about a half of the period in the related art in which the resin did not flow out.

Assuming that the pregrouted PC steel material 10 was wound around a drum, the pregrouted PC steel material 10 was subjected to a bending test (curvature radius: 1.0 m, held for 30 seconds). Exudation of the filling resin 4 was not found.

Figure 3:
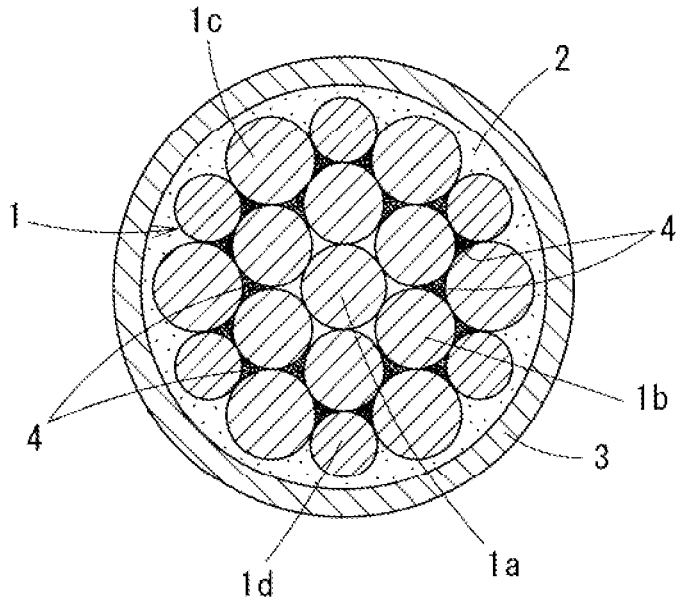
FIG. 3 is a cross-sectional view of another embodiment.
Figure 4:
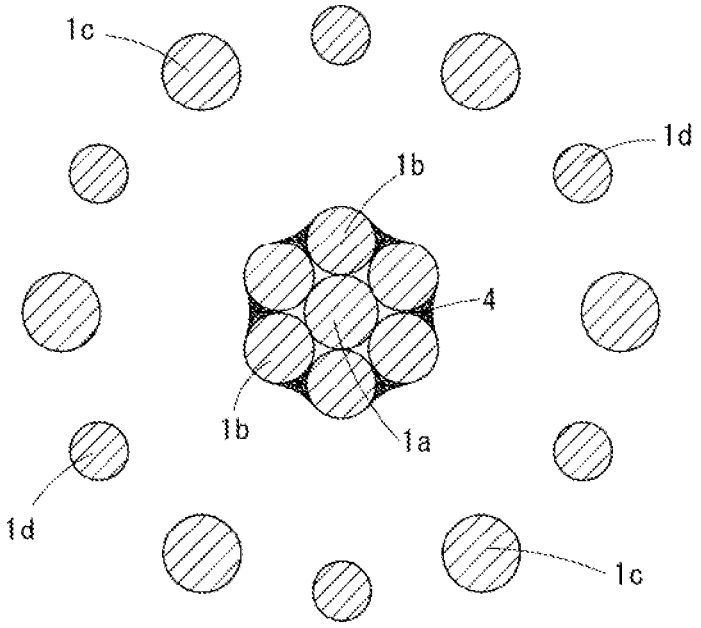
FIG. 4 is an explanatory view illustrating production of the embodiment.
Figure 5:
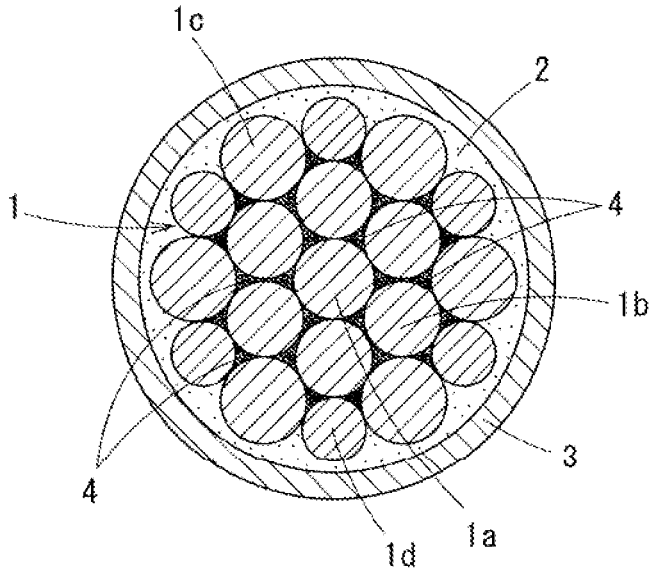
FIG. 5 is a cross-sectional view of a further embodiment.
Figure 6:
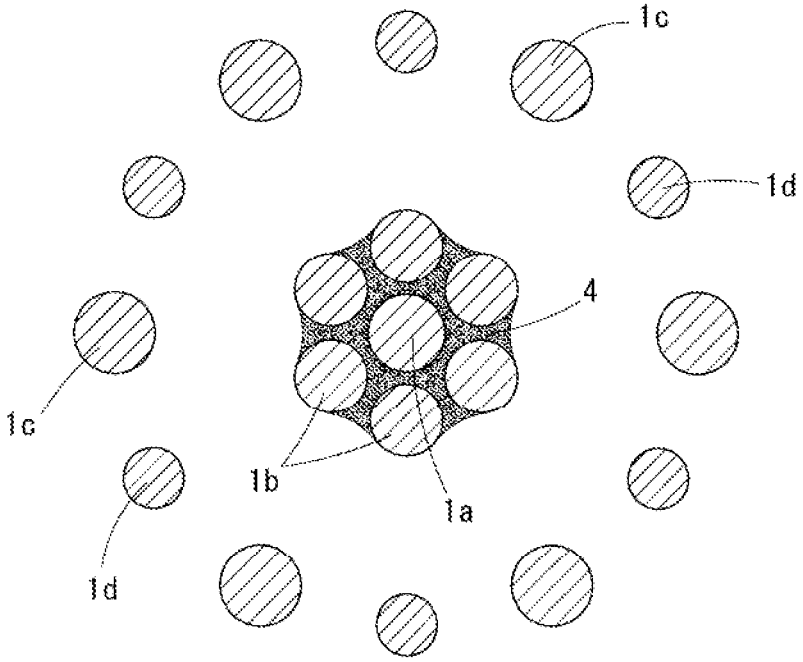
FIG. 6 is an explanatory view illustrating production of the embodiment.

In this embodiment, as illustrated in FIG. 3, the filling resin 4 can be filled (in the gaps) between the adjacent side wires 1*b* and 1*b* in the inner layer and the side wires 1*c*. At this time, as illustrated in FIG. 4, while the side wires 1*c* and 1*d* are partly and sequentially detwisted and opened, a strand composed of the remaining steel wires 1*a* and 1*b* is passed through the kneading tank of the filling resin 4. Further, as illustrated in FIG. 5, the filling resin 4 can also be filled (in the gaps) between the core wire 1*a* and the side wires 1*b* in the inner layer. At this time, as illustrated in FIG. 6, the side wires 1*c* and 1*d* are partly and sequentially detwisted and opened, the side wires 1*b* are slightly detwisted, and a detwisted strand composed of the steel wires 1*a* and 1*b* is passed through the kneading tank of the filling resin 4. In any of the cases, the strand 1 illustrated in FIG. 2A is used, and is passed through the die 5 illustrated in FIG. 2C.

To confirm that the pregrouted PC steel material 10 according to the present invention is excellent, in the pregrouted PC steel material 10 having the structure of the above embodiment illustrated in FIG. 1, Test Examples 1 to 6 of filling resin 4 having compositions shown in the following Table 1 were prepared. After a tensioning load of 726.3 kN was applied to Test Examples 1 to 6, Test Examples 1 to 6 were stored at 70° C., and the days until the durometer hardness of a type D indenter of a pregrouted layer 2 reached 20 were evaluated. Test Examples 1 to 5 correspond to examples of the present invention, and Test Example 6 corresponds to the related art.

TABLE

| | | Test Example 1 | Test Example 2 | Test Example 3 | Test Example 4 | Test Example 5 | Test Example 6 |
|---|---|---|---|---|---|---|---|
| Filling resin | Curing agent component (1) (phr) | Ketimine 10 | Ketimine 100 | Imidazole 100 | Polyamine 100 | Polyamine 90 | None |
| | Curing agent component (2) (phr) | — | — | — | — | Imidazole 10 | |
| | Filler (1) (phr) | Calcium oxide 15 | Talc 50 | Talc 50 | Talc 50 | Talc 50 | |
| | Filler (2) (phr) | Silica 5 | — | — | — | — | |
| | Binder component (phr) | Epoxy resin 100 | — | — | — | — | |
| Hours until durometer hardness D reaches 20 (70° C., accelerated) | | 240 | 225 | 129 | 42 | 45 | 276 |

From the comparison between Test Examples 1 to 5 and Test Example 6, it can be confirmed that the number of days until the pregrouted layer 2 cures alter tensioning is decreased by filling the filling resin 4. Further, from the comparison of Test Examples 1 to 5, it can be confirmed that the number of days until the pregrouted layer 2 cures after tensioning decreases as the content of the curing agent component in the filling resin 4 increases. Still further, it can be confirmed that polyamine is excellent as the curing agent.

Figure 7:
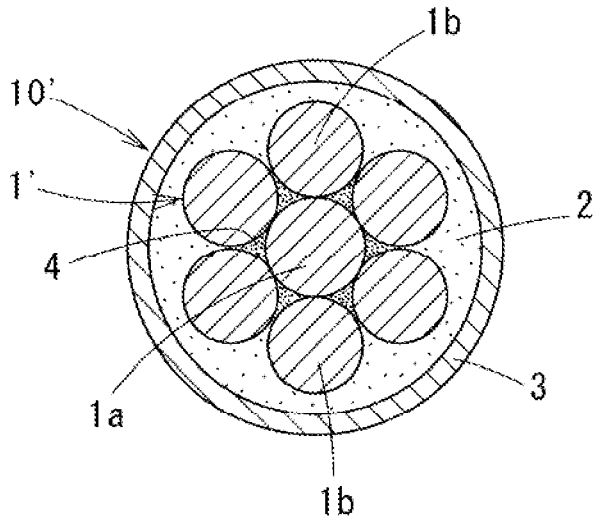
FIG. 7 is a cross-sectional view of a still further embodiment.

The present invention can, of course, also be adopted in a seven-wire-twisted pregrouted PC steel material 10' in which six side wires 1*b* are twisted together around a core wire 1*a*, as illustrated in FIG. 7. Similarly to the above, in this pregrouted PC steel material 10', the side wires 1*b* in a strand 1' are partly and sequentially detwisted and opened, and the remaining steel wire (core wire 1*a*) is passed through a kneading tank of a filling resin 4. After that, the strand 1' is passed through a die having an inner peripheral surface shape corresponding to an outer peripheral surface shape of the strand 1' to remove the filling resin 4 in a part of the outer peripheral surface of the strand 1'. Also, the filling resin 4 is filled (in the gaps) between the side wires 1*a* and 1*b*.

Figure 8:
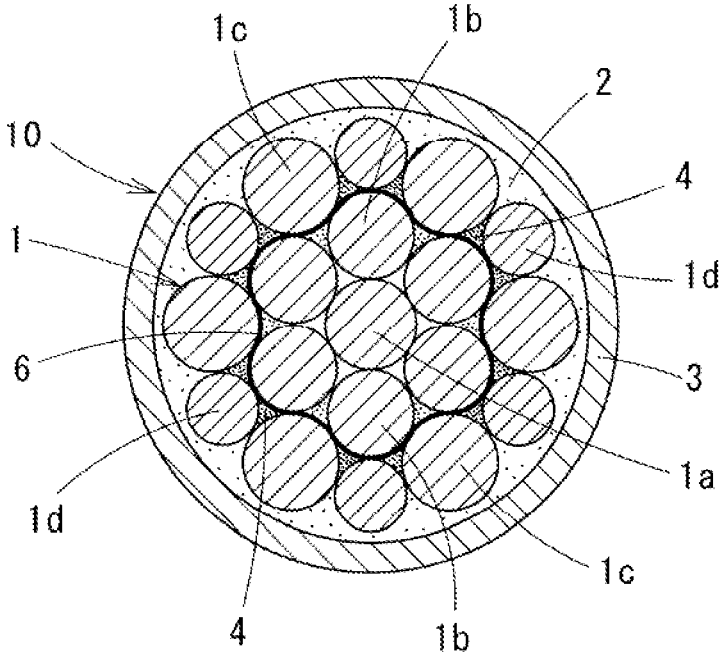
FIG. 8 is a cross-sectional view of an even still further embodiment.

To increase the amount of filling resin 4 to be exuded by the tensioning load, the gap between the layers can be widened by interposing a spacer or the like among the core wire 1*a*, the inner layer steel wires 1*b*, and the outer layer steel wires 1*c* and 1*d*. While various types of spacers or the like are conceivable, for example, as illustrated in FIG. 8, when a stringlike spacer 6 is wound on the outer periphery of the inner layer steel wires 1*b*, it widens the gap surrounded in portions surrounded by the inner layer steel wires 1*b* and the outer layer steel wires 1*c* and 1*d*. Moreover, the filling resin 4 can enter portions within the space in the string of the spacer 6 and surrounded by the side wires 1*b* and 1*c* (see FIGS. 1 and 8). Instead of the stringlike spacer 6, for example, a porous sheet or grains, such as capsules, can be interposed between the core wire 1*a*, the inner layer steel wires 1*b*, and the outer layer steel wires 1*c* and 1*d*. Alternatively, a tapelike spacer 6 can be wound with a gap. The cupules can contain a filling resin.

Incidentally, the present invention is not limited only to the case in which the conventional curing agent is not compounded in the pregrouted layer 2 at all. For example, when the pregrouted layer 2 is required to have a certain viscosity at the time of tensioning of the PC strand 1 or 1', it is necessary to obtain a curing action by appropriately compounding a curing agent. In such, a case, the required amount of curing agent is, of course, compounded beforehand. That is, as described above, the present invention aims to promote curing of the pregrouted layer 2 by exudation of the filling resin 4 at the time of tensioning of the PC strand 1 or 1'.

Well-known grout materials other than epoxy resin can be appropriately adopted, and, of course, a filling resin 4 is adopted according to the grout materials.

In this way, it should be considered that the embodiments disclosed herein are merely examples in all respects, but are not restrictive. The scope of the present invention is defined by the claims, and it is intended to include all modifications within the scope of the claims and the equivalents thereof.

REFERENCE SIGNS LIST

1, 1' PC strand
1*a* core wire (steel wire)
1*b* inner layer side wire (steel wire)
1*c* outer layer side wire (steel wire)
1*d* outer layer side wire (steel wire)
2 pregrouted layer
3 sheath
4 filling resin
5 die
6 spacer
10,10' PC steel material

The invention claimed is:

1. A pregrouted PC steel material comprising: a PC strand formed by twisting a plurality of steel wires; a pregrouted layer disposed on an outer periphery of the PC strand to contain the PC strand; and a sheath configured to cover an outer periphery of the pregrouted layer, wherein in a cross section perpendicular to a longitudinal direction, the PC strand has a steel wire forming a core wire, steel wires forming an inner layer provided on the core wire, and steel wires forming a continuous outer layer provided on the inner layer, a filling resin configured to promote curing of the pregrouted layer is filled between the steel wires in the PC strand, and the filling resin does not exude to the pregrouted layer before tensioning of the PC strand, and exudes to the pregrouted layer owing to a tensioning force during the tensioning, the filling resin is only filled between the steel wire forming the core wire and the steel wires forming the inner layer and/or between the steel wires forming the inner layer and the steel wires forming the outer layer, and the filling resin exudes to the pregrout layer along with contraction of a gap between the steel wires of the PC strand due to tensioning of the PC strand.

2. The pregrouted PC steel material according to claim 1, wherein a gap filled with the filling resin between layers of the steel wires is widened by interposing a spacer between the layers.

3. The pregrouted PC steel material according to claim 1, wherein the pregrouted layer is formed of epoxy resin or a resin mainly composed of epoxy resin, and the filling resin is a curing agent for the epoxy resin.

4. The pregrouted PC steel material according to claim 1, wherein the pregrouted layer is formed of epoxy resin or a resin mainly composed of epoxy resin, and the filling resin is a mixture of epoxy resin and a curing agent for the epoxy resin.

5. The pregrouted PC steel material according to claim 1, wherein a filler is added to the filling resin to achieve thickening, to improve a thixotropic property, or to prevent dripping.

6. A curing method for the pregrouted layer in the pregrouted PC steel material according to claim 1, wherein the pregrouted PC steel material is buried in concrete, and the filling resin is caused to flow into the pregrouted layer to cure the pregrouted layer by the tensioning force when the PC strand is tensioned to apply compressive force to the concrete.

* * * * *